US006105357A

United States Patent [19]

Weinberg

[11] Patent Number: 6,105,357

[45] **Date of Patent: *Aug. 22, 2000**

[54] METHOD AND APPARATUS FOR MAKING HOLLOW SEAMLESS LINKS FOR USE IN JEWELRY

[76] Inventor: Eitan Weinberg, 16-16 Split Rock Rd., Fairlawn, N.J. 07410

[ * ] Notice: This patent is subject to a terminal disclaimer.

[21] Appl. No.: 08/455,192

[22] Filed: May 31, 1995

[51] Int. Cl.[7] ..... B21L 1/00

[52] U.S. Cl. ..... 59/35.1; 59/20

[58] Field of Search ..... 59/1, 3, 20, 35.1

[56] References Cited

U.S. PATENT DOCUMENTS

| | | | |
|---|---|---|---|
| 214,874 | 4/1879 | Beugnies . | |
| 404,956 | 6/1889 | Burdon . | |
| 440,258 | 11/1890 | Billault . | |
| 944,640 | 12/1909 | Ungerer et al. | 59/35.1 |
| 1,053,726 | 2/1913 | Hamm et al. | 59/1 |
| 1,081,451 | 12/1913 | Kerk . | |
| 1,143,696 | 6/1915 | Finckh . | |
| 1,145,429 | 7/1915 | Maisenbacher | 59/35.1 |
| 1,324,807 | 12/1919 | Gibbs et al. . | |
| 4,503,664 | 3/1985 | Allazetta et al. . | |
| 4,986,067 | 1/1991 | Caccialupi | 59/3 |
| 5,125,225 | 6/1992 | Strobel . | |
| 5,285,625 | 2/1994 | Ofrat et al. | 59/35.1 |
| 5,303,540 | 4/1994 | Rozenwasser | 59/80 |
| 5,452,572 | 9/1995 | Alvaro et al. . | |
| 5,531,065 | 7/1996 | Rozenwasser | 59/80 |

FOREIGN PATENT DOCUMENTS

| | | | |
|---|---|---|---|
| 53-70861 | 6/1978 | Japan | 59/3 |
| 2 279 227 | 1/1995 | United Kingdom . | |

*Primary Examiner*—David Jones
*Attorney, Agent, or Firm*—Edgar H. Haug; Curtis Morris & Safford, P.C.

[57] ABSTRACT

Method and apparatus for making hollow links or rings and for making chain made from hollow links by receiving seamless wire which has an inner core and an exterior surface, for example, a gold alloy surface, making a perforation in the wire so as to expose the inner core at the perforation, and forming the wire into an open or closed link such that the perforation is located on a hidden portion of the link. The inner core may then be removed from the open or closed link by dissolving it in acid, wherein the acid contacts the inner core at the perforation thus allowing the acid to dissolve the inner core. A chain may be made by coupling each link with at least one preceding link to produce the chain.

17 Claims, 5 Drawing Sheets

METHOD AND APPARATUS FOR MAKING HOLLOW SEAMLESS LINKS FOR USE IN JEWELRY

BACKGROUND OF THE INVENTION

The present invention relates to method and apparatus for making hollow seamless links for use in jewelry and, more particularly, to method and apparatus for making hollow seamless gold links for use in a chain, for example, a gold chain made in the form of a rope (a "gold rope chain").

U.S. Pat. No. 4,503,664 (Allazzetta et al.), which is incorporated herein by reference, discloses a rope chain machine which manufactures chains by cutting gold solid wire fed to the machine into successive pieces and forming the cut pieces into open rings on a movable conveyor pin. The rings, which also are known as "links", are combined in a known manner to produce the completed rope chain.

Traditionally, a gold chain is manufactured from 10KT, 14KT, etc, gold solid wire which generally results in a relatively heavy chain. One method for reducing the weight of a chain is to flatten each link prior to assembly. Another method is to construct a chain with hollow links.

A chain made of hollow links or rings, hereinafter "hollow chain", may be made by forming a thin sheet of gold alloy around a wire core made of another material (hereinafter referred to as "the non-gold core"), for example, aluminum, steel or copper. The gold alloy sheet and the non-gold core are drawn through a dial to form a wire which has a gold exterior surface and a non-gold inner core. The resultant wire contains a seam, as will be described below. Individual links made from this wire are produced by various methods. One method is to curl the wire around a rod so as to take on a spring-like form whereby the spring-like wire is cut along the length of the rod to produce open links. The links are then flattened.

As previously stated, the resultant wire contains a seam, that is, the gold alloy sheet does not completely encompass the entire circumference of the non-gold core wire, as shown in FIG. 1 of the drawings, and thus, the non-gold core material remains visible after the gold alloy is folded around the wire (or rather, the non-gold core material is exposed to air along the seam). It is generally necessary for the wire to have a seam to properly carry out the non-gold removal process (as will be described). However, because the existence of a seam adversely affects each link's appearance, thus substantially diminishing the resultant chain's overall appearance, it is essential that each link be made to have its seam located on the inner circumference thereof. In other words, a seam must be located on the interior side of the link so that it will not be exposed, i.e., visible, on the completed product.

Once a chain is manufactured, the non-gold core of each link must be removed to produce the "hollow" chain. Currently, it is known to remove a non-gold core material, such as aluminum, copper or steel, from a gold chain by dissolving the non-gold core in acid. Of course, such an acid does not dissolve the exterior gold-alloy surface of the links. When the non-gold core dissolves, gases are produced which escape through the seam of the link and, although it is appreciated that the existence of a seam in each link provides for the removal of the inner cores, the required seams cause production of hollow chain to be difficult because these seams must always be located on the inner circumference of the links in order to not degrade the appearance of the completed product. Given the relatively small size of a link, production of links with seams on their inner circumference is relatively difficult, or, at best, substantially limits the number of practical methods of producing such links. Furthermore, the existence of a seam reduces the link's overall strength, for example, by reducing the link's ability to keep its shape when subject to external forces, e.g., during ordinary handling or during formation of the link.

OBJECTS OF THE INVENTION

Therefore, it is an object of the present invention to provide method and apparatus for making hollow seamless links or rings for use in jewelry, for example, a gold chain, which overcome the shortcomings of the above-described processes and resultant products.

Another object of the present invention is to provide links or rings whose interior core is easily removable without the need for a seam in each link/ring.

A further object of this invention is to provide method and apparatus for making a chain, for example, a gold rope chain, from hollow seamless links or rings whose respective interior cores are easily removable.

An additional object of this invention is to provide method for making links/rings, whose interior cores may easily be removed, which may be applied to known methods and apparatuses for making chains.

Various other objects, advantages and features of the present invention will become readily apparent to those of ordinary skill in the art, and the novel features will be particularly pointed out in the appended claims.

SUMMARY OF THE INVENTION

In accordance with one embodiment of the present invention, method and corresponding apparatus for making a hollow link or ring for use in jewelry operate to receive a wire (e.g., which is seamless) which has an inner core and an exterior surface (e.g., made of a gold alloy), make a perforation in the wire so as to expose the inner core at the perforation, and form the wire into a link or ring, e.g., open or closed, such that the perforation is located on the inner surface of the link/ring.

As one aspect of the present invention, the inner core is removed from the wire as by dissolving it, for example, in an acid which dissolves the inner core but does not dissolve the exterior surface, in which the acid contacts the inner core at the perforation sight in the wire.

As another aspect of the present invention, perforations are made in the wire so that the inner core is exposed at each of the perforations, and wherein the perforations are located (e.g., at equidistant locations) on the inner surface of the link.

As yet a further aspect of this invention, the perforation is made in the inner surface of the link before, during or after its formation.

In accordance with another embodiment of the present invention, method and corresponding apparatus for making a chain, for example, a rope chain, from hollow links or rings (e.g., open or closed) operate to receive a wire (e.g., a seamless wire) which has an inner core and an exterior surface (e.g., made of a gold alloy), make perforations in the wire to expose the inner core at each of the perforations, cut pieces of predetermined length from the wire, form each piece of wire into a link/ring in which each piece of wire has at least one perforation therein, and couple each link/ring with at least one preceding link/ring to produce a chain.

As one aspect of this invention, perforations are made in the wire before, during or after the formation of the links/ rings in which at least one perforation is made on the inner surface of each link.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF CERTAIN PREFERRED EMBODIMENTS

In accordance with the present invention, method and apparatus is provided in which holes or perforations (or aperture) are made at various locations of each link/ring in order to provide links/rings whose inner non-gold core may easily be removed and where such links/rings may be combined to produce a chain in which the existence of the holes in the links/rings do not degrade the appearance of the chain, do not reduce the strength of the links, and do not reduce the strength of the fabricated chain. Hereinafter, the term "link(s)" also refers to "ring(s)", and therefore, reference to "link(s)" is not to be construed as a limitation of this invention.

Figure 1:
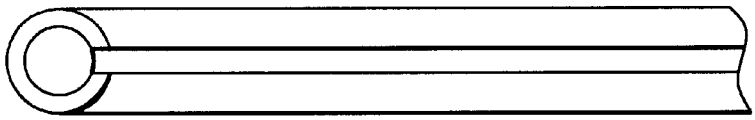
FIG. 1 schematically illustrates a gold wire having a gold alloy surface exterior with a seam and a non-gold core.
Figure 2:
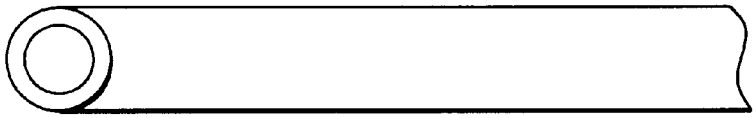
FIG. 2 schematically illustrates a gold wire having a gold alloy surface exterior without a seam and a non-gold core.

FIG. 2 of the drawings illustrates a seamless wire used in the present invention which has a gold alloy surface exterior and a non-gold core interior. The production of such seamless wire having different inner core and surface materials is well-known in the art and forms no part of the present invention, and therefore, for purposes of brevity, a description of such known methods is omitted from the description hereof. As previously stated, it is advantageous to use seamless wire in the production of links and chain over wire with a seam because seamless wire does not require the placement of a seam on the inner circumference of each link, and further, seamless wire produces seamless links which are stronger than links with seams.

The present invention contemplates using other materials as the outer surface of the wire, for example, platinum, silver, etc., and using other materials as the inner core of the wire, for example, aluminum, copper, steel, etc. However, for purposes of clarity, the outer surface material of the wire hereinafter is referred to as the gold alloy exterior, or similar phrase, and the inner core material hereinafter is referred to as the non-gold core, or similar phrase, and, therefore, such references should not be construed as limitations to this invention.

Figure 3A:
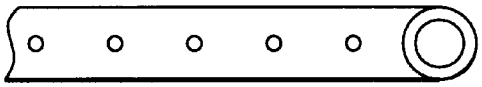
FIGS. 3A to 3C schematically illustrate several different types of perforations that may be made in the wire in accordance with the present invention.
Figure 3B:
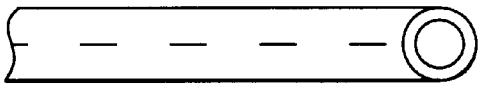
Figure 3C:
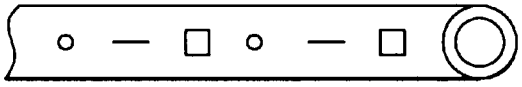

The present invention consists of adding a single hole (i.e., aperture) or a multiple number of holes to the gold alloy exterior surface of the wire to cause the non-gold core to be exposed to air, as illustrated in FIG. 3A, in the manner to be described. Such holes may be added either prior to, during or after individual links are formed. As an alternative to adding round holes to the wire, other types of perforations may be made in the gold alloy surface to expose the non-gold core, for example, narrow slots may be made in the wire as illustrated in FIG. 3B, or varying shaped perforations may be made in the wire as illustrated in FIG. 3C. Therefore, the present invention is not limited by the number, size or shape of the perforations that may be made in the seamless wire.

A chain is fabricated from the above-described wire in the manner to be described. After fabrication of a chain, the non-gold core of each link in the chain is removed by placing (e.g., immersing) the completed chain in an acid which dissolves the non-gold core but which does not dissolve the gold-alloy exterior surface of the wire. Since removal of a core material from wire with a seam by immersing the wire in particular acids is well-known in the art, a discussion of such types of acids is hereby omitted. In accordance with the present invention, the acid contacts the non-gold core at the perforation sights in the wire which allows the acid to dissolve the non-gold core, for example, as by allowing gases that are produced during the dissolving process to escape through the perforations in each of the links. Thus, the non-gold core of each link in the chain may be removed without the existence of a seam. In another embodiment of this invention, the non-gold core is removed from each link prior to the chain's construction. In this instance, the non-gold core of each link is removed by placing individual links in an appropriate acid to produce individual hollow links, at which time various jewelry may be made using these hollow links.

Figure 4:
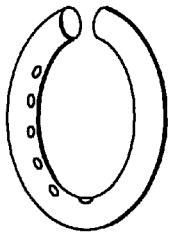
FIG. 4 illustrates an exemplary link having holes on its inner circumference.

In accordance with this invention, a single hole or perforation or a multiple number of holes or perforations are located on each link at locations that are not visible on a completed chain made from such links. FIG. 4 illustrates an exemplary link having three holes on its inner circumference. It is noted, however, that perforations may be made at other locations that ultimately will be hidden, that is, not visible, on jewelry produced from such links. This may include perforations on the outside of "hollow" wire formed into, for example, an earring, which is shaped such that the outside areas of various wires used in the earring are not visible on the completed product.

In the preferred embodiment of this invention, at least three holes are made in the inner circumference of each link. In this instance, the time required to dissolve the inner core is shorter than the time required to dissolve the inner core of links each having only a single hole therein.

Figure 5A:
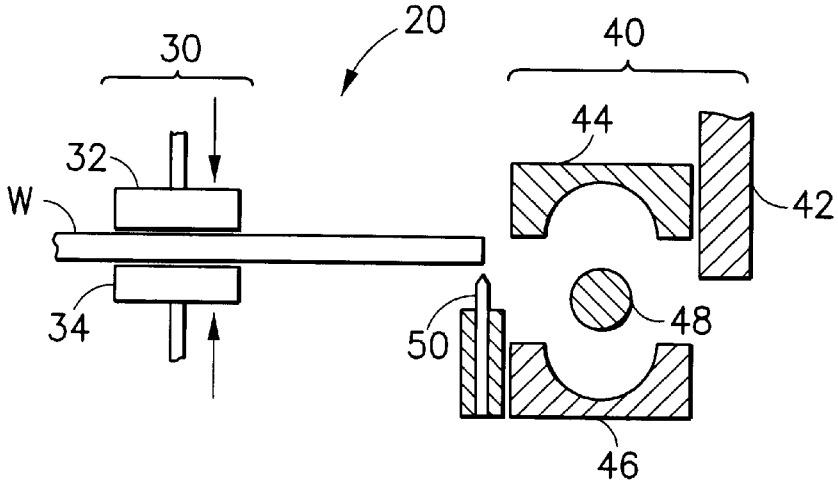
FIGS. 5A to 5E are schematic illustrations of various successive stages of the formation of links having perforations in accordance with the present invention.

The process of making links with perforations on their inner circumference from a wire having a gold alloy exterior and a non-gold core in which the perforations are made in the wire prior to the formation of individual links will now be described with reference to FIGS. 5A to 5E. As illustrated in FIG. 5A, a seamless wire W, which has a gold alloy exterior and a non-gold core, is supplied to a link fabricating apparatus 20 which contains a wire feed mechanism 30 and a link forming unit 40. Wire W fed to link fabricating apparatus 20 may have a round (i.e., circular) cross-section, or other desired cross-section, for example, oval, triangular, rectangular, square, "U"-shaped, etc. Top and bottom wire grabbing surfaces 32, 34 of wire feed mechanism 30 grab a portion of the fed wire W on opposite sides by moving in respectively opposite directions towards one another as shown. In a preferred embodiment of this invention, bottom grabbing surface 34 makes perforations in the bottom portion of wire W as it is being grabbed. Because bottom surface 34 makes contact with that portion of wire W which will ultimately become its internal circumference when the wire is formed into a link, the perforations made are also located on the internal circumference of the resultant link, and is further described below.

Figure 5B:
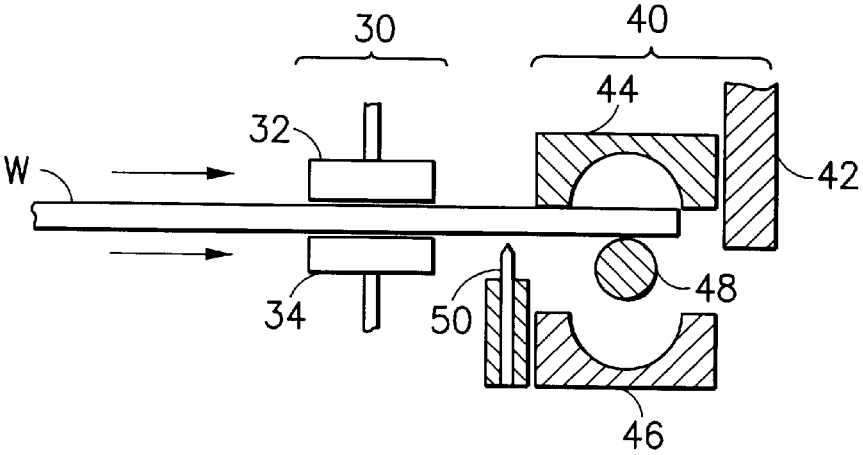

After wire W is grabbed, the wire is drawn by grabbing surfaces 32, 34 towards link forming unit 40 in the direction shown in FIG. 5B. As is appreciated, the drawn distance generally corresponds to the circumference of a formed link. The front portion of wire W passes through link forming unit 40 stopping at a stop member 42 which serves to stop wire W from passing too far therethrough. At this time, wire W is disposed directly between a top forming die 44 and a rod 48 of link forming unit 40 and is ready to be cut and formed into a link.

Figure 5C:
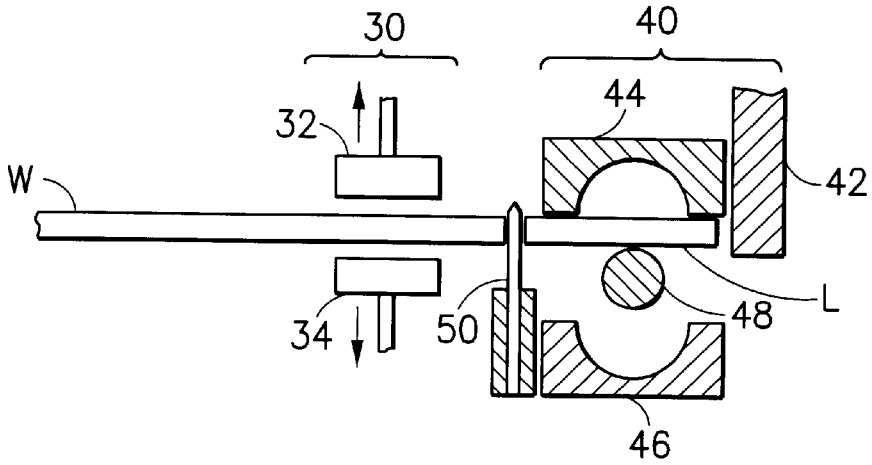
Figure 5D:
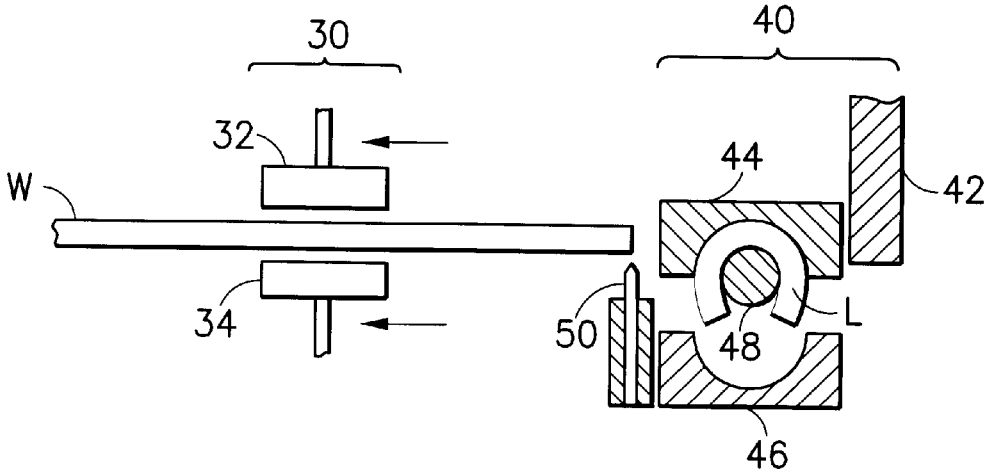
Figure 5E:
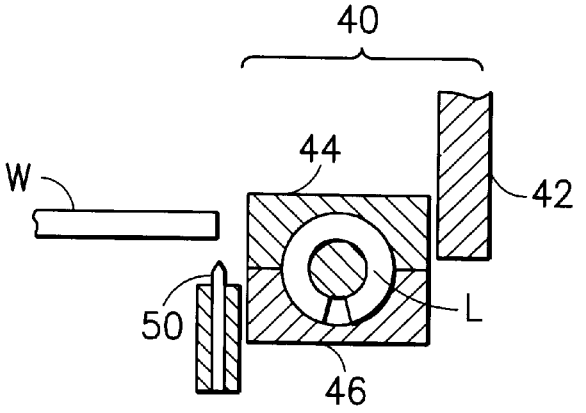

A cutter 50 in link forming unit 40 is raised which cuts off a portion L of wire W which has passed through unit 40, as shown in FIG. 5C. Subsequently, top forming die 44 is brought into a lowered position which deforms the cut portion L of the wire thereby wrapping it around the top of rod 48. Cut portion L thus takes on an upside-down "U"-shaped configuration, as shown in FIG. 5D. At this point, bottom forming die 46 is raised to bring it into contact with the cut portion L thereby further wrapping the wire around the bottom of rod 48 so as to produce an open link, as shown in FIG. 5E, and it is noted that the link may be made either open or closed. The link may then be used to produce a chain, for example, rope chain, or other jewelry in any known manner, and since the fabrication of a chain and other jewelry is well-known in the art, for example, as illustrated in the Allazzetta patent previously referred to, description of such fabrication is hereby omitted.

Figure 6:
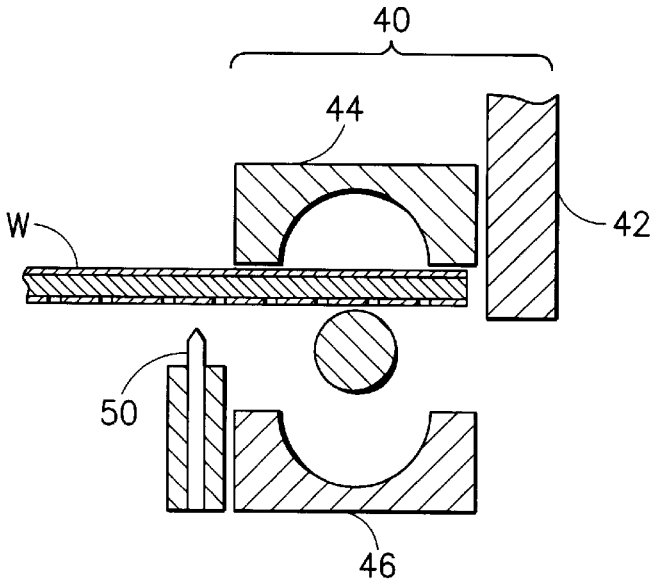
FIG. 6 is a schematic diagram illustrating the locations of perforations made in the wire in accordance with one embodiment of the present invention.
Figure 7A:
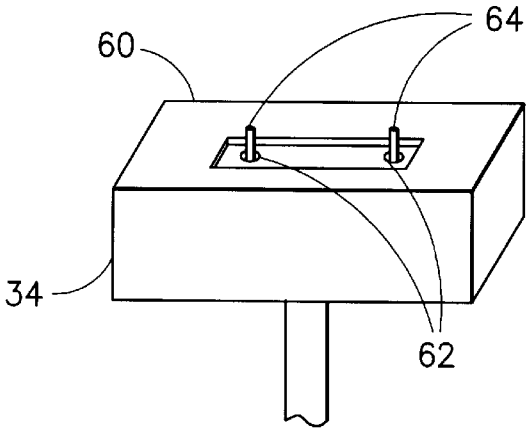
FIGS. 7A and 7B illustrate two ways of perforating the wire in accordance with the present invention.

As stated above, perforations are made in the wire by bottom grabbing surface 34 before the wire is cut and formed into a link. FIG. 6 is a schematic diagram illustrating the locations of perforations made in wire W by bottom grabbing surface 34, and from the above discussion with reference to FIGS. 5A to 5E, it is readily apparent that such perforations ultimately become located on the inner circumference of the formed link. Perforations in the wire may be made by bottom grabbing surface 34 in a variety of ways. For example, and as shown in FIG. 7A, bottom grabbing surface 34 may include a spring-like surface 60 on a small portion thereof which includes one or more holes 62 to allow a hole-punching pin or pins 64 (or needles) to pass therethrough when top and bottom grabbing surfaces 32, 34 grab the wire. Pins 64 extend through the holes 62 of bottom grabbing surface 34 thereby perforating the bottom portion of the wire (see FIG. 6). Such pins also provide assistance in grabbing the wire as it is drawn towards link forming unit 40. When top and bottom grabbing surfaces 32, 34 release the wire (see FIG. 5C) so that they may retract away from link forming unit 40, the spring-like surface 60 of bottom grabbing surface 34 springs fractionally upward which causes pins 64 to recede below holes 62 contained therein. The recession of pins 64 below holes 62 in bottom grabbing surface 34 permits bottom grabbing surface 34 to freely move away from link forming unit 40.

Figure 7B:
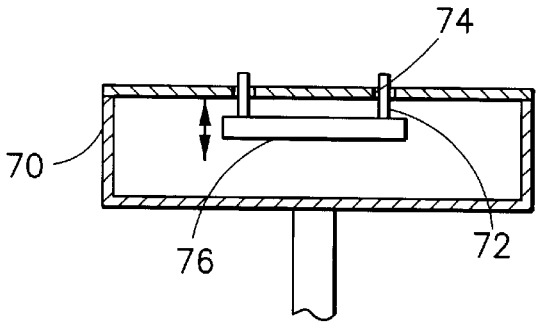

FIG. 7B illustrates another bottom grabbing surface 70 which perforates the bottom of the wire by momentarily forcing a pin 72 through a hole 74 contained therein. Bottom grabbing surface 70 includes a force unit 76 which forces pin 72 therethrough and through the bottom of the wire either while the wire is stationary or while it is being drawn to link forming unit 40. As another example, the bottom grabbing surface may simply include a perforating pin or needle extending outwardly whereby the wire is perforated when top and bottom grabbing surfaces 32, 34 grab the wire (FIG. 5A) and is released when grabbing surfaces 32, 34 retract away from the wire (FIG. 5C).

Figure 8A:
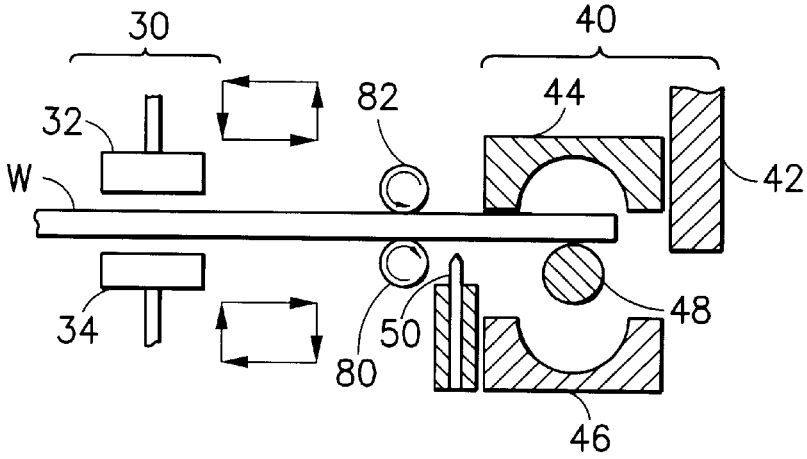
FIGS. 8A and 8B illustrate another embodiment of the present invention in which a perforating roller makes perforations in the bottom of the wire.
Figure 8B:
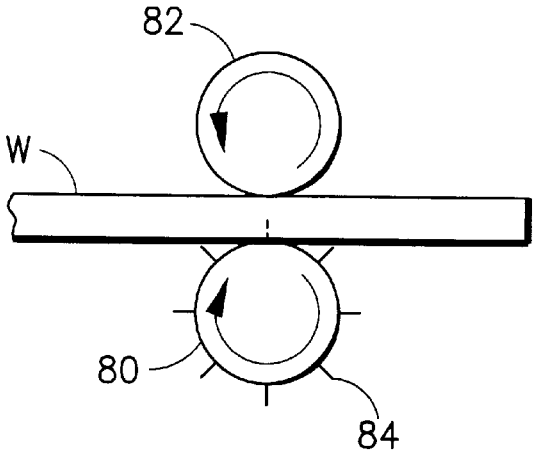

FIGS. 8A and 8B illustrate another embodiment of the present invention in which a perforating roller device 80 makes perforations in the bottom of the wire. As shown in FIG. 8A, grabbing surfaces 32, 34 (which do not perforate the wire) drive wire W through perforating roller 80 and a roller 82 which perforate the wire prior to its entry into link forming unit 40. However, rollers 80, 82 may be located at other locations preceding the actual formation of the link. Pins 84 extending from perforating roller 80, as shown in FIG. 8B, perforate wire W at equidistant or non-equidistant locations as the wire travels therethrough. The present invention may also be applied to manually perforating a wire (e.g., by hand) by using a perforating device similar to device 80 shown in FIG. 8B, or other such perforating device that allows one to make perforations in wire, as previously described.

Figure 9:
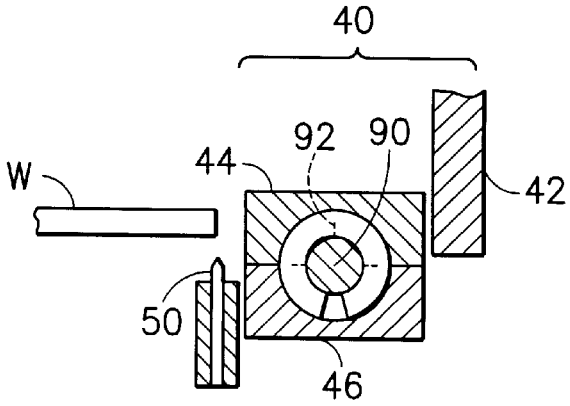
FIG. 9 illustrates an embodiment of the present invention in which perforations are made in the wire when the link is formed.

FIG. 9 illustrates an embodiment of this invention in which perforations are made in the wire when the link is formed. As shown, a rod 90 in link forming unit 40 includes pins 92 on the surface thereof which perforate the wire on its inner circumference as the wire is formed into a link or after the wire has been formed into a link, for example, in the manner described above (see FIGS. 5A to 5E). Upon completion of the formation and perforation of the link, pins 92 retract into rod 90 so as to allow the removal of the link therefrom.

It is seen that this invention allows for the manufacturing of a chain, for example, rope chain, made of hollow seamless links in which each link does not require a seam in order to provide for the removal of the inner non-gold material. Such links are far superior to links with seams because of their greater strength, e.g., greater resistance to deformation, which generally is sacrificed by the existence of seams. As previously stated, perforations or holes in a link do not have any substantial impact on the strength or shape of the link, and thus, manufacturing a chain from such links is not affected by the existence of these perforations.

This invention further provides for means and methods to easily place holes in the wire at locations which are not visible in the completed chain. On the other hand, production of links with seams on their inner circumference is substantially more difficult since a seam is an inherent part of such wire, and therefore, cannot be strategically positioned on the wire after its formation. Such, therefore, requires the wire to be properly oriented (i.e., rotated) to ensure that the seam is located at a position which ultimately becomes the inner circumference of the link. As is well-known in the art, such orientation is difficult and further complicates the link fabrication process.

Furthermore, it is appreciated that placement of holes in the inner circumference of a link does not reduce the link's strength since it is that material on the outer surface of the link which is stretched when the link is formed, for example, by the above-described process. In addition, the formation of holes in a wire may be made in any known manner, for example, progressive punching of the wire may be used whereby two or more punches are made on that portion of a wire which represents a single link. However, this invention is not limited to the manner of how individual holes in the wire are made, as can be appreciated from the above description.

It is further contemplated that the perforations in the wire may be of any shape, size and number suitable for the manufacture of hollow products. Thus, it is intended that this invention not be limited to any specific arrangement, number, shape or manner in which holes are made in each of the links to be used in a chain, for example, rope chain, or any other chain or non-chain, including bangles, earrings, etc.

While the present invention has been particularly shown and described in conjunction with preferred embodiments thereof, it will be readily appreciated by those of ordinary skill in the art that various changes and modifications may be made without departing from the spirit and scope of the invention. For example, although this invention has been described in conjunction with a machine for manufacturing hollow seamless links, it may be used in conjunction with other automatic or manual (e.g., hand-made) processes of fabricating hollow seamless links or processes of fabricating a chain using hollow seamless links. For example, a perforation device may be designed to manually place a hole at equidistant locations on a wire prior to the cutting of the wire to form the individual links.

As another example, although the present discussion is directed to manufacturing hollow seamless gold links for use in a chain, the present invention is not limited solely to hollow seamless gold links, and may be applied to hollow links made of silver, platinum, or other precious metal, or non-precious metal, or other material in which it may be desirable to use this invention.

Still further, the above-described process may also be used in the manufacturing of hollow wire, hollow links or hollow rings to be used in jewelry, such as links that are used in different types of chains, or non-chains, including bangles, earrings, etc. The present invention still may be applied to the manufacture of diamond cut rope chain or other such jewelry. In this instance, after the rope chain is fabricated, but prior to dissolving the inner cores of the links in acid, the outer surface (e.g., gold surface) is diamond cut to produce flat surfaces of gold, as is well known in the art. Because the inner cores have yet to be removed, such diamond cutting of rope chain is easy to implement. The inner cores are then removed from such diamond cut rope chain in the manner previously discussed.

Therefore, it is intended that the appended claims be interpreted as including the embodiments described herein, the alternatives mentioned above, and all equivalents thereto.

What is claimed is:

1. A method of making a hollow link or ring for use in a rope chain said link or ring being made in a machine from a seamless wire having an inner core and an exterior surface, said machine comprising feed means having upper and lower gripping members for gripping and advancing said wire, into pieces to be formed into said links and cutting means for cutting said wire, comprising the steps of:

advancing and perforating said wire while advancing it along a path towards said cutting means, the wire being perforated by said lower gripping member of said feed means so as to expose the inner core at the perforations;

cutting pieces of predetermined length from said perforated wire by said cutting means, each cut piece of wire having at least one perforation therein;

forming each piece of wire into a respective link having an inner surface and an outer surface, said at least one perforation of each said link being located on the inner surface of the respective link; and coupling each said link with at least one preceding link to produce a chain in the form of a rope.

2. The method of claim 1, further comprising the step of diamond cutting portions of the exterior surface of each of said links of said chain having the form of a rope to produce a diamond cut rope chain having flat surfaces thereon.

3. The method of claim 2, further comprising the step of removing the inner core from each link of the diamond cut rope chain.

4. The method of claim 1, further comprising the step of dissolving the inner core of each said link of the chain through the perforation in the respective link.

5. The method of claim 4, wherein the inner core is made of a first material and the exterior surface is made of a second material, and said step of dissolving is carried out by dissolving the inner core in an acid capable of substantially dissolving the first material but not substantially dissolving the second material.

6. The method of claim 1, wherein said step of forming forms each piece of wire into a respective substantially circular link.

7. The method of claim 1, wherein the step of cutting cuts pieces of predetermined length from the wire each having a plurality of perforations therein exposing the inner core at each of the plurality of perforations of each cut piece of wire.

8. The method of claim 7, wherein the step of cutting cuts pieces of predetermined length from the wire each having the perforations therein at equidistant locations.

9. The method of claim 1, wherein the step of receiving receives a seamless wire having said inner core and a gold alloy exterior surface.

10. The method of claim 1, wherein the step of coupling couples the links to produce said chain in a manner such that said at least one perforation of each said link is not visible on the produced chain.

11. An apparatus for making a hollow link or ring for use in jewelry from a seamless wire having an inner core and an exterior surface, comprising:

feed means for gripping and advancing the wire along a path through said apparatus, said feed means comprising upper and lower gripping members which operate to grip and advance the wire along said path, said lower gripping member including perforating means for making a plurality of perforations along the wire, thereby exposing the inner core at the perforations as said lower gripping member grips the wire;

cutting means located on said apparatus for receiving the wire from said feed means for cutting pieces of predetermined length from the wire having said perforations therein, each cut piece of wire having at least one perforation therein;

link forming means located on said apparatus for forming each of said cut piece of wire into a respective link having an inner surface and an outer surface, the perforation of each said link being located on the inner surface of the respective link; and coupling means coupled to said link forming means for coupling each said link with at least one preceding link to produce a chain in the form of a rope.

12. The apparatus of claim 11, wherein said link forming means forms each piece of wire into a respective substantially circular link.

13. The apparatus of claim 11, wherein said cutting means cuts pieces of predetermined length from the wire each having a plurality of perforations therein exposing the inner core at each of the plurality of perforations of each cut piece of wire.

14. The apparatus of claim 13, wherein the perforations in each said cut piece of wire are at equidistant locations.

15. The apparatus of claim 11, wherein the receiving means receives a seamless wire having said inner core and a gold alloy exterior surface.

16. The apparatus of claim 11, wherein said coupling means couples the links to produce said chain in a manner such that said at least one perforation of each said link is not visible on the produced chain.

17. The apparatus of claim 11, wherein said link forming means is comprised of a top forming die for forming a respective cut piece of wire into a partially formed link having the perforation therein located on an inner surface thereof and a bottom forming die for forming the partially formed link into said link.

* * * * *